US010232976B2

(12) United States Patent
Waddington

(10) Patent No.: US 10,232,976 B2
(45) Date of Patent: Mar. 19, 2019

(54) DISPENSING CARTON

(71) Applicant: Graphic Packaging International, Inc., Atlanta, GA (US)

(72) Inventor: Paul Waddington, Castleford (GB)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 15/657,705

(22) Filed: Jul. 24, 2017

(65) Prior Publication Data

US 2018/0022503 A1 Jan. 25, 2018

Related U.S. Application Data

(60) Provisional application No. 62/366,240, filed on Jul. 25, 2016.

(51) Int. Cl.

| | |
|---|---|
| ***B65D 5/72*** | (2006.01) |
| ***B31B 50/26*** | (2017.01) |
| ***B65D 5/42*** | (2006.01) |
| ***B65D 5/02*** | (2006.01) |
| ***B65D 5/38*** | (2006.01) |
| *B31B 110/20* | (2017.01) |
| *B31B 120/60* | (2017.01) |

(52) U.S. Cl.

CPC ..... *B65D 5/728* (2013.01); *B31B 50/26* (2017.08); *B65D 5/0209* (2013.01); *B65D 5/0281* (2013.01); *B65D 5/38* (2013.01); *B65D 5/4266* (2013.01); *B31B 2110/20* (2017.08); *B31B 2120/60* (2017.08)

(58) Field of Classification Search

CPC .... B65D 5/728; B65D 5/0209; B65D 5/2081; B65D 5/38; B65D 5/4266; B65D 83/0463; B65D 59/04; B65D 2583/0454; B31B 50/26; B31B 2110/20; B31B 2120/60

USPC ..... 229/122, 125.125, 125; 206/531, 528, 206/540

See application file for complete search history.

(56) References Cited

U.S. PATENT DOCUMENTS

| | | | |
|---|---|---|---|
| 1,951,274 | A | 3/1934 | Denman |
| 2,069,281 | A | 2/1937 | Sebreny |

(Continued)

FOREIGN PATENT DOCUMENTS

| | | |
|---|---|---|
| CH | 412 695 | 4/1966 |
| CH | 681293 | 2/1993 |

(Continued)

OTHER PUBLICATIONS

International Search Report and Written Opinion for PCT/US2017/043477 dated Oct. 30, 2017.

*Primary Examiner* — Christopher Demeree

(74) *Attorney, Agent, or Firm* — Womble Bond Dickinson (US) LLP

(57) ABSTRACT

A carton for holding at least one article includes a dispenser that includes a dispenser feature and at least two first panels extending at least partially around an interior of the dispenser. The carton also includes a sleeve including at least two second panels extending at least partially around an interior of the sleeve. The interior of the sleeve at least partially receives the dispenser, and the dispenser is in slidable engagement with the sleeve and is moveable between a first position in which the dispenser feature is inaccessible and a second position in which the dispenser feature is accessible.

61 Claims, 15 Drawing Sheets

(56) References Cited

U.S. PATENT DOCUMENTS

| | | | | |
|---|---|---|---|---|
| 2,335,363 | A | 11/1943 | Shelton | |
| 2,610,770 | A | 9/1952 | Penfield | |
| 2,898,004 | A | 8/1959 | Klausmann et al. | |
| 2,943,769 | A | 7/1960 | Klausmann | |
| 2,975,952 | A | 3/1961 | Tamarin | |
| 2,980,540 | A | 4/1961 | Turpin | |
| 2,983,424 | A | 5/1961 | Glass | |
| 3,033,436 | A | 5/1962 | Peimer | |
| 3,040,953 | A | 6/1962 | Tindall | |
| 3,057,524 | A | 10/1962 | Shanks | |
| 3,114,474 | A | 12/1963 | Davis | |
| 3,166,229 | A | 1/1965 | Sherman et al. | |
| 3,187,961 | A | 6/1965 | Moore | |
| 3,235,144 | A | 2/1966 | Pitkin et al. | |
| 3,298,576 | A | 1/1967 | Sellors | |
| 3,302,847 | A | 2/1967 | Hennessey | |
| 3,347,446 | A | 10/1967 | Guyer et al. | |
| 3,441,002 | A | 4/1969 | Lawalin et al. | |
| 3,563,449 | A | 2/1971 | Forbes, Jr. | |
| 3,804,321 | A | 4/1974 | Forbes, Jr. | |
| 3,831,833 | A | 8/1974 | Dressler et al. | |
| 3,894,680 | A | 7/1975 | Araki | |
| 3,921,862 | A | 11/1975 | Holmstrom | |
| 4,081,128 | A | 3/1978 | O'Neill | |
| 4,094,456 | A | 6/1978 | Raccaforte | |
| 4,111,351 | A | 9/1978 | Mackiernan | |
| 4,113,086 | A | 9/1978 | Forbes, Jr. | |
| 4,138,016 | A | 2/1979 | Roccaforte | |
| 4,141,485 | A | 2/1979 | Lambert | |
| 4,197,985 | A | 4/1980 | Austin | |
| 4,201,329 | A | 5/1980 | Roccaforte | |
| 4,261,483 | A | 4/1981 | Dutcher | |
| 4,279,373 | A | 7/1981 | Montealgre | |
| 4,342,417 | A | 8/1982 | Forbes, Jr. | |
| 4,361,270 | A | 11/1982 | Roccaforte | |
| 4,609,142 | A | 9/1986 | Adamek | |
| 5,056,708 | A | 10/1991 | Boyle et al. | |
| 5,429,297 | A | 7/1995 | Walsh | |
| 5,465,834 | A | 11/1995 | Sieber et al. | |
| 5,503,268 | A * | 4/1996 | Pham | B65D 5/728 206/249 |
| 5,810,250 | A | 9/1998 | Stone et al. | |
| 5,875,962 | A | 3/1999 | Jorgensen-Beck et al. | |
| 6,047,829 | A * | 4/2000 | Johnstone | B65D 5/38 206/1.5 |
| 6,213,388 | B1 | 4/2001 | Ours et al. | |
| 6,230,893 | B1 * | 5/2001 | Karow | B65D 5/38 206/1.5 |
| 6,318,593 | B1 | 11/2001 | Laughlin et al. | |
| 6,412,636 | B1 * | 7/2002 | Jones | B65D 5/38 206/532 |
| 6,752,272 | B2 * | 6/2004 | Jones | B65D 5/38 206/232 |
| 6,945,449 | B2 | 9/2005 | Hengami | |
| 7,156,286 | B2 | 1/2007 | Hengami | |
| 7,503,475 | B2 | 3/2009 | McGowan | |
| 8,800,855 | B2 | 8/2014 | Fitzwater | |
| 2004/0065723 | A1 | 4/2004 | Hengami | |
| 2011/0168767 | A1 | 7/2011 | Hengami | |
| 2013/0313311 | A1 | 11/2013 | Fath et al. | |
| 2015/0083789 | A1 | 3/2015 | Fitzwater et al. | |

FOREIGN PATENT DOCUMENTS

| | | |
|---|---|---|
| GB | 385033 | 12/1932 |
| JP | 2011-173640 A | 9/2011 |
| JP | 2011-189978 A | 9/2011 |
| NL | 100017 | 12/1961 |

* cited by examiner

DISPENSING CARTON

CROSS-REFERENCE TO RELATED APPLICATION

This application claims the benefit of U.S. Provisional Patent Application No. 62/366,240, filed on Jul. 25, 2016.

INCORPORATION BY REFERENCE

The disclosure of U.S. Provisional Patent Application No. 62/366,240, filed on Jul. 25, 2016, is hereby incorporated by reference for all purposes as if presented herein in its entirety.

BACKGROUND OF THE DISCLOSURE

The present disclosure generally relates to cartons with a dispenser for one or more articles stored therein. In particular, the present disclosure is directed to a carton having a dispenser that is at least partially slidably receivable in a sleeve.

SUMMARY OF THE DISCLOSURE

In one aspect of the disclosure, a carton for holding at least one article comprises a dispenser and a sleeve. The dispenser comprises a dispenser feature and at least two first panels extending at least partially around an interior of the dispenser, the dispenser comprising a dispenser feature. The sleeve comprises at least two second panels extending at least partially around an interior of the sleeve. The interior of the sleeve at least partially receives the dispenser, and the dispenser is in slidable engagement with the sleeve and is moveable between a first position in which the dispenser feature is inaccessible and a second position in which the dispenser feature is accessible.

In another aspect of the disclosure, a blank for forming a carton for holding at least one article comprises at least two first panels and at least two second panels. The at least two first panels are for extending at least partially around an interior of a dispenser, and at least one panel of at least two first panels comprising a dispenser feature. The at least two second panels are for extending at least partially around an interior of a sleeve, and the interior of the sleeve is for at least partially receiving the dispenser when the carton is formed from the blank. The dispenser is for being in slidable engagement with the sleeve and is moveable between a first position in which the dispenser feature is inaccessible and a second position in which the dispenser feature is accessible when the carton is formed from the blank.

In another aspect of the disclosure, a method of forming a carton for holding at least one article comprises obtaining a blank comprising at least two first panels and at least two second panels. The method also comprises folding the at least two first panels around an interior of a dispenser having at least one dispenser feature and folding the at least two second panels around an interior of a sleeve such that the sleeve at least partially receives the dispenser and the sleeve is in slidable engagement with the sleeve such that the dispenser is movable between a first position in which the dispenser feature is inaccessible and a second position in which the dispenser feature is accessible.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts may be designated by corresponding reference numbers throughout the drawings.

DETAILED DESCRIPTION OF THE EXEMPLARY EMBODIMENTS

Cartons or packages according to the present disclosure can accommodate articles of numerous different shapes. For the purpose of illustration and not for the purpose of limiting the scope of the disclosure, the following detailed description describes articles such as food products at least partially disposed within the carton embodiments. In this specification, the terms "lower," "bottom," "upper", "top", "front", and "back" indicate orientations determined in relation to fully erected cartons.

Figure 1:
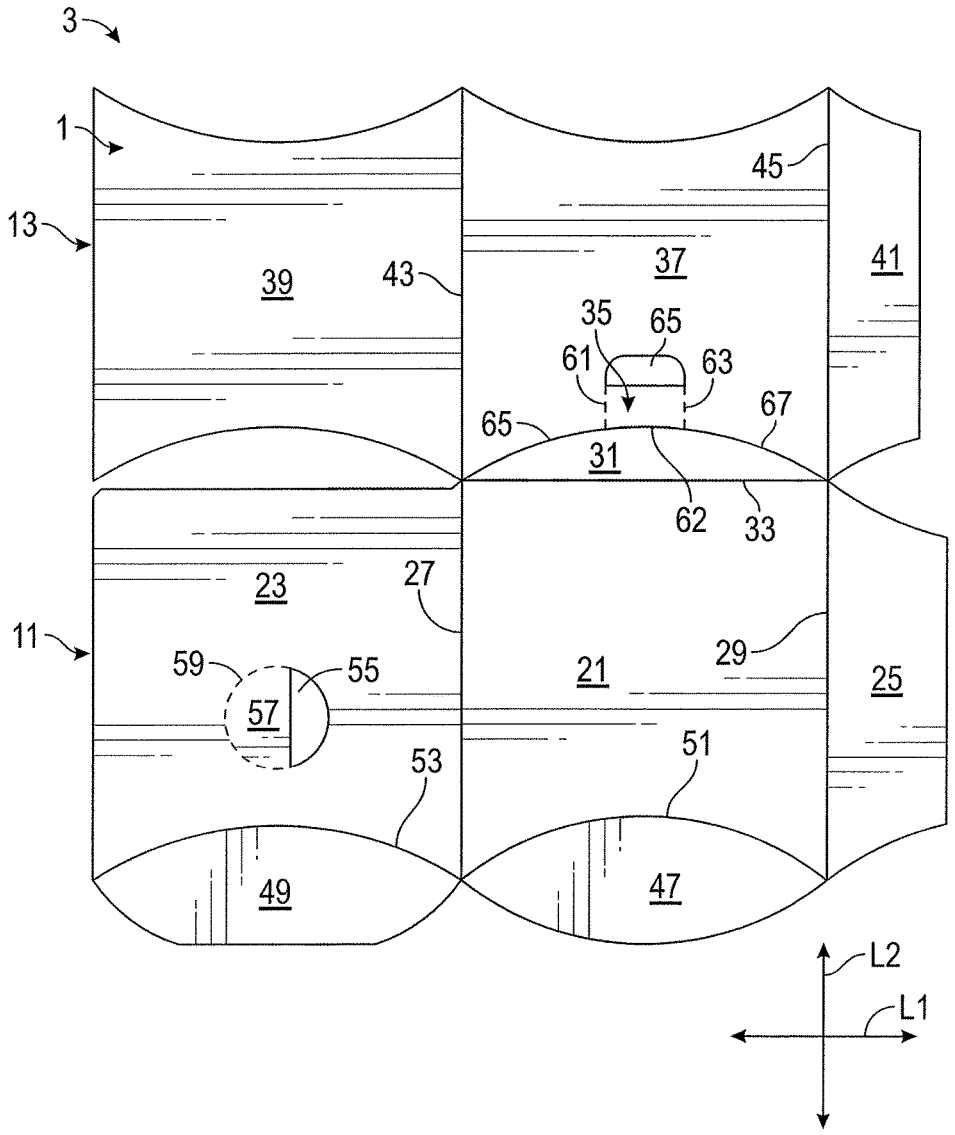
FIG. 1 is a plan view of a blank for forming a carton according to a first exemplary embodiment of the disclosure.
Figure 2:
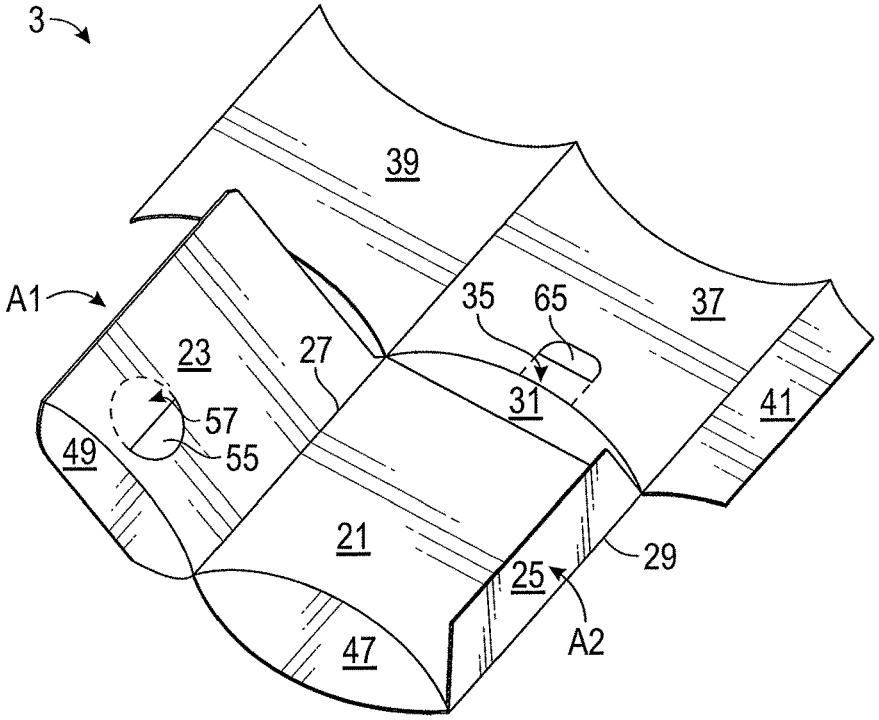
FIG. 2 is a first sequential perspective view of an assembly of the blank of FIG. 1 according to the first exemplary embodiment of the disclosure.

FIG. 1 is a plan view of the interior side 1 of a blank, generally indicated at 3, that can be obtained and used to form a carton 5 (FIG. 6) according to a first exemplary embodiment of the disclosure. The carton 5 includes a dispenser 7 (FIG. 6) for holding and/or dispensing one or more article P (FIG. 10), e.g., a food product, and the dispenser 7 is slidably removable from a sleeve 9 (FIG. 6) that at least partially surrounds the dispenser 7.

As shown in FIG. 1, the blank 3 has a longitudinal axis L1 and a lateral axis L2. In the illustrated embodiment, the blank 3 includes a first dispenser panel 21 foldably connected to a second dispenser panel 23 and an attachment flap 25 at respective lateral fold lines 27, 29. A bottom flap 31, as shown, is foldably connected to the first dispenser panel 21 at a longitudinal fold line 33, and defines a tab 35 extending from a portion thereof, as described further herein. As also shown in FIG. 1, a first sleeve panel 37 is foldably connected to a second sleeve panel 39 and an attachment flap 41 at respective lateral fold lines 43, 45.

In the illustrated embodiment, top flaps 47, 49 are foldably connected to the respective first and second dispenser panels 21, 23 at respective fold lines 51, 53, which may be curved, as shown, or may have a different configuration. As also shown, the second dispenser panel 23 includes one or more dispenser features such as a dispenser opening 55 with a dispenser tab 57 separably connected to a portion of the dispenser panel 23 surrounding the dispenser opening 55 at a tear line 59 such that the dispenser tab 57 partially covers the dispenser opening 55. In embodiments, the dispenser tab 57 may fully cover the dispenser opening 55.

Still referring to FIG. 1, the tab 35 of the bottom flap 31 is separably connected to the first sleeve panel 37 at lateral tear lines 61, 63. The tab 35 may be foldably connected to the bottom flap 31 at a fold line 62 extending between the tear lines 61, 63, as shown, or, in embodiments, may be devoid of foldable connection to the bottom flap 31. As shown, an opening 65 is defined on the first sleeve panel 37 adjacent the tab 35, and the bottom flap 31 is separated from the first sleeve panel 37 by cuts 65, 67 adjacent the tab 35, which may be curved, as shown, or may have a different configuration. In this regard, the tab 35 forms a region of connection between the first sleeve panel 37 and the first dispenser panel 21. The first dispenser panel 21, the second dispenser panel 23, the attachment flap 25, and the flaps 31, 47, 49 may form a dispenser portion 11 of the blank 3 and the first sleeve panel 37, the second sleeve panel 39, and the attachment flap 41 may form a sleeve portion 13 of the blank 3 such that when the tab 35 is removed from the first sleeve panel 37, the dispenser portion 11 and the sleeve portion 13 of the blank 3 are separable so that the dispenser 7 can be removed from the sleeve 9 when the carton 5 (FIG. 6) is formed.

It will be understood that the panels 21, 23, 37, 39, the flaps 25, 31, 41, 47, 49, and/or other portions of the blank 3 may be otherwise shaped or configured without departing from the disclosure.

Figure 3:
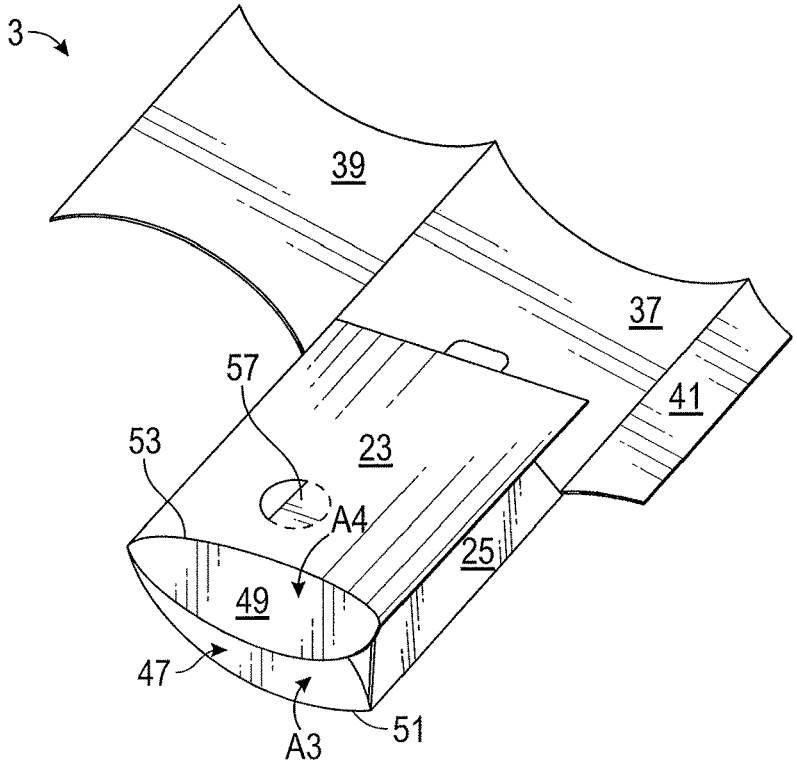
FIG. 3 is a second sequential perspective view of an assembly of the blank of FIG. 1 according to the first exemplary embodiment of the disclosure.
Figure 10:
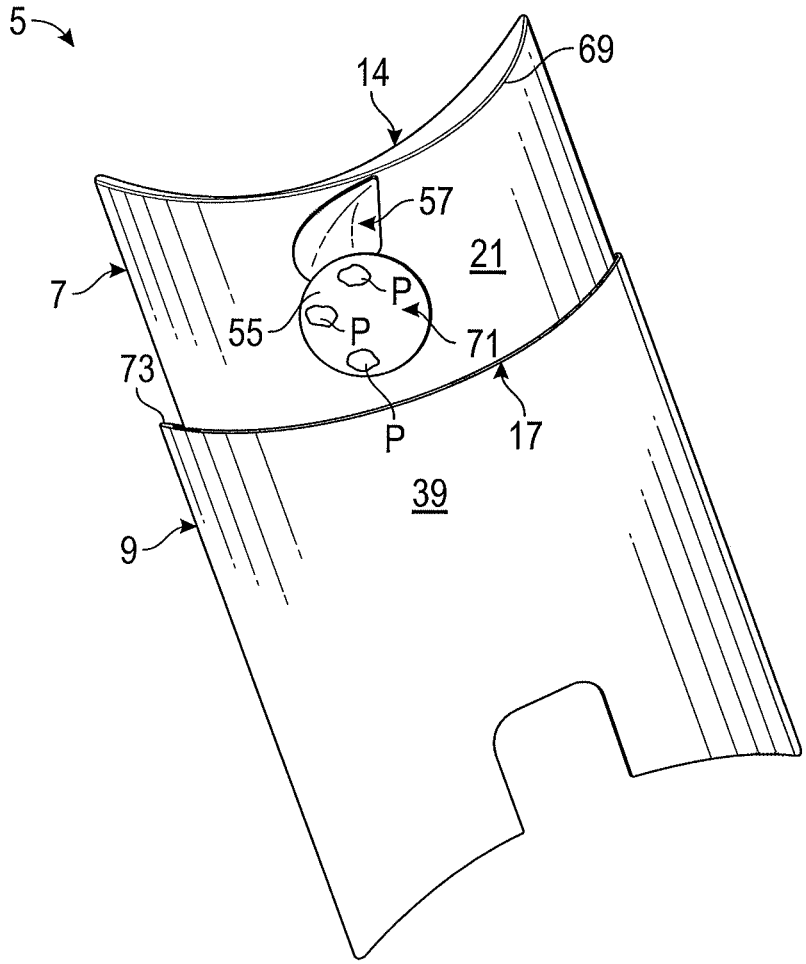
FIG. 10 is a fourth sequential perspective view of the carton of FIG. 6 in use according to the first exemplary embodiment of the disclosure.

Still referring to FIG. 1, and referring additionally to FIGS. 2-5, erection of the carton 5 (FIG. 6) from the blank 3 according to one exemplary embodiment of the disclosure will be illustrated. As shown, the second dispenser panel 23 can be folded at the fold line 27 in the direction of arrow A1 to be in facing relation with the first dispenser panel 21 and the attachment flap 25 can be folded at the fold line 29 in the direction of the arrow A2 to be in at least partial face-to-face contact with the second dispenser panel 23 to form an interior 71 of the dispenser 7 (FIG. 10). As shown in FIG. 3, the top flaps 47, 49 can be folded at respective fold lines 51, 53 to be in at least partial face-to-face contact and form a closed top 14 of the dispenser 7 (FIG. 6) at respective arrows A3, A4. As shown, the top flaps 47, 49 can be arranged with the top flap 49 overlying the top flap 47.

Figure 4:
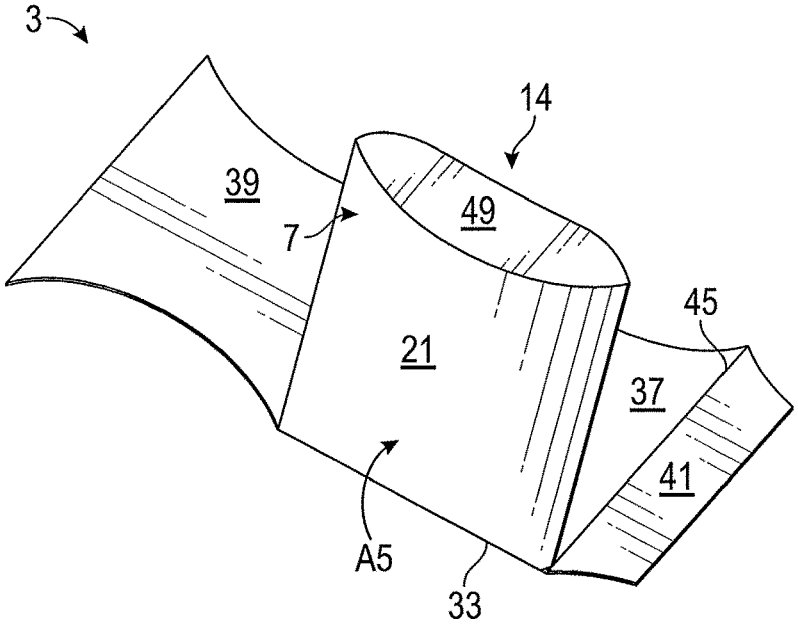
FIG. 4 is a third sequential perspective view of an assembly of the blank of FIG. 1 according to the first exemplary embodiment of the disclosure.
Figure 5:
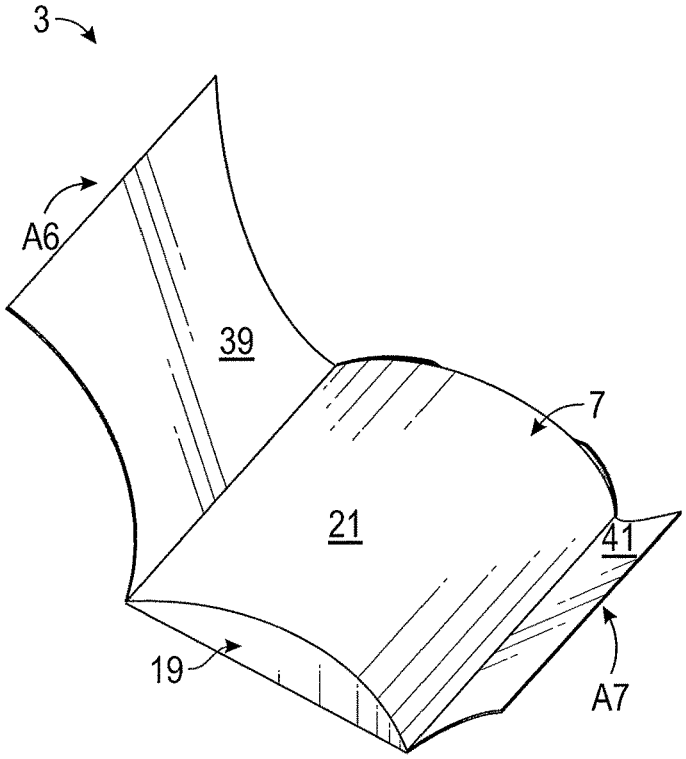
FIG. 5 is a fourth sequential perspective view of an assembly of the blank of FIG. 1 according to the first exemplary embodiment of the disclosure.
Figure 6:
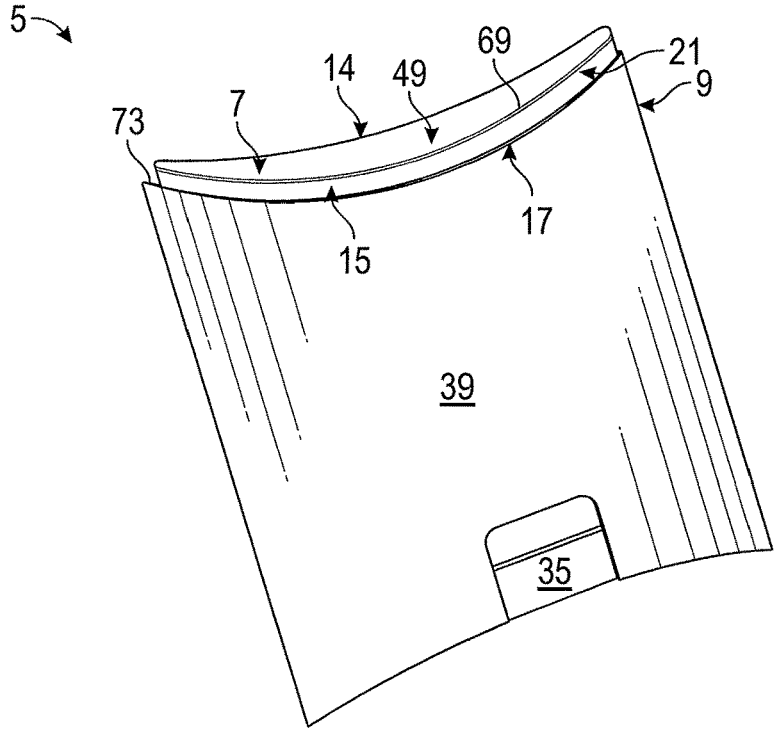
FIG. 6 is a perspective view of a carton formed from the blank of FIG. 1 according to the first exemplary embodiment of the disclosure.

Referring to FIGS. 1 and 4, the first dispenser panel 21 can be folded at the fold line 33 in the direction of the arrow A5 such that the second dispenser panel 23 is in at least partial face-to-face contact with the first sleeve panel 37 and with the flap 31 overlapping the second dispenser panel 23 to form a closed bottom 19 (FIG. 5) of the carton 5 (FIG. 6). Referring additionally to FIG. 5, the second sleeve panel 39 can be folded at the fold line 43 in the direction of the arrow A6 to be in at least partial face-to-face contact with the first dispenser panel 21 and the attachment flap 41 can be folded at the fold line 45 in the direction of the arrow A7 to be in at least partial face-to-face contact with the second sleeve panel 39. In this regard, the sleeve 9 is formed having an interior 73 (FIG. 6) within which the dispenser 7 is at least partially received and through which the dispenser 7 is slidably movable relative to the remainder of the carton 5.

As described herein, adhesive such as glue may be applied to portions of the blank 3 to maintain the above-described arrangement of the panels 21, 23, 37, 39 and the flaps 25, 31, 41, 47, 49. For example, glue may be applied to portions of the attachment flaps 25, 41, the fold line 27, 29, 45, 43, and portions of the flap 31.

It will be understood that one or more articles P (FIG. 10) can be placed in the interior 71 of the dispenser 7 at any desired point in the assembly of the carton 5, for example, prior to overlapping of the top flaps 47, 49. Articles P may be, for example, loaded manually or with a loading apparatus, and multiple articles P may be held in the carton 5 in a separate (e.g., loose) arrangement or may be grouped, for example, with a liner, bag, or other packaging.

Referring to FIG. 6, the carton 5 is illustrated in a fully-assembled configuration. As shown, a top portion 15 of the dispenser 7 is illustrated protruding through a top portion 17 of the sleeve 9. As shown, a portion of the flap 49 of the closed top 14 protrudes past the first dispenser panel 21 and an edge of the second sleeve panel 39 along the top portion 17 of the sleeve 9 to form a lip 69 of the dispenser 7. As described further herein, the lip 69 can engage the top portion 17 of the sleeve 9 to inhibit or prevent further slidable movement of the dispenser 7 downwardly into the interior 73 of the sleeve 9 such that the lip 69 and the top portion 17 of the sleeve 9 are stopping features of the carton 5.

Figure 7:
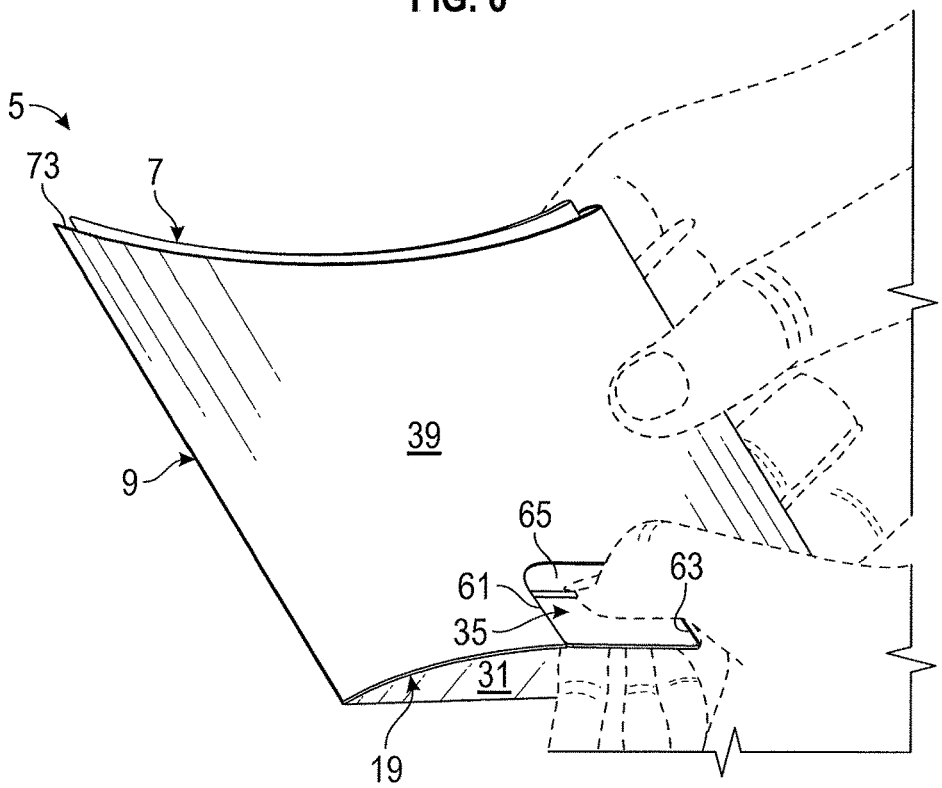
FIG. 7 is a first sequential perspective view of the carton of FIG. 6 in use according to the first exemplary embodiment of the disclosure.
Figure 8:
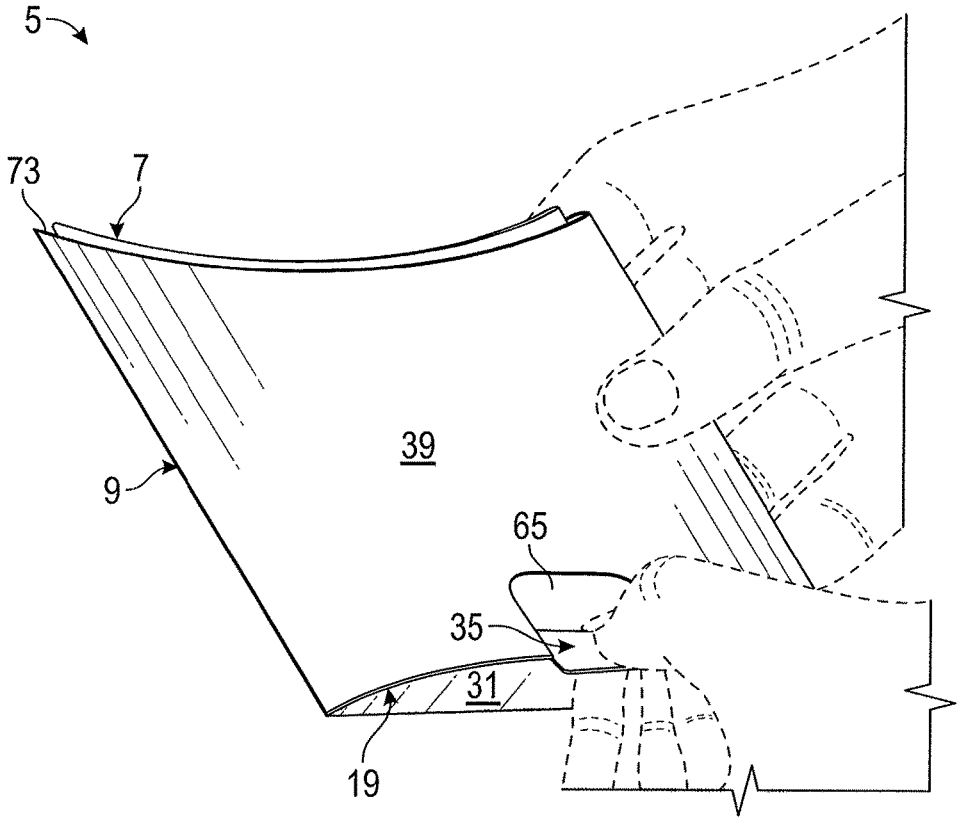
FIG. 8 is a second sequential perspective view of the carton of FIG. 6 in use according to the first exemplary embodiment of the disclosure.
Figure 9:
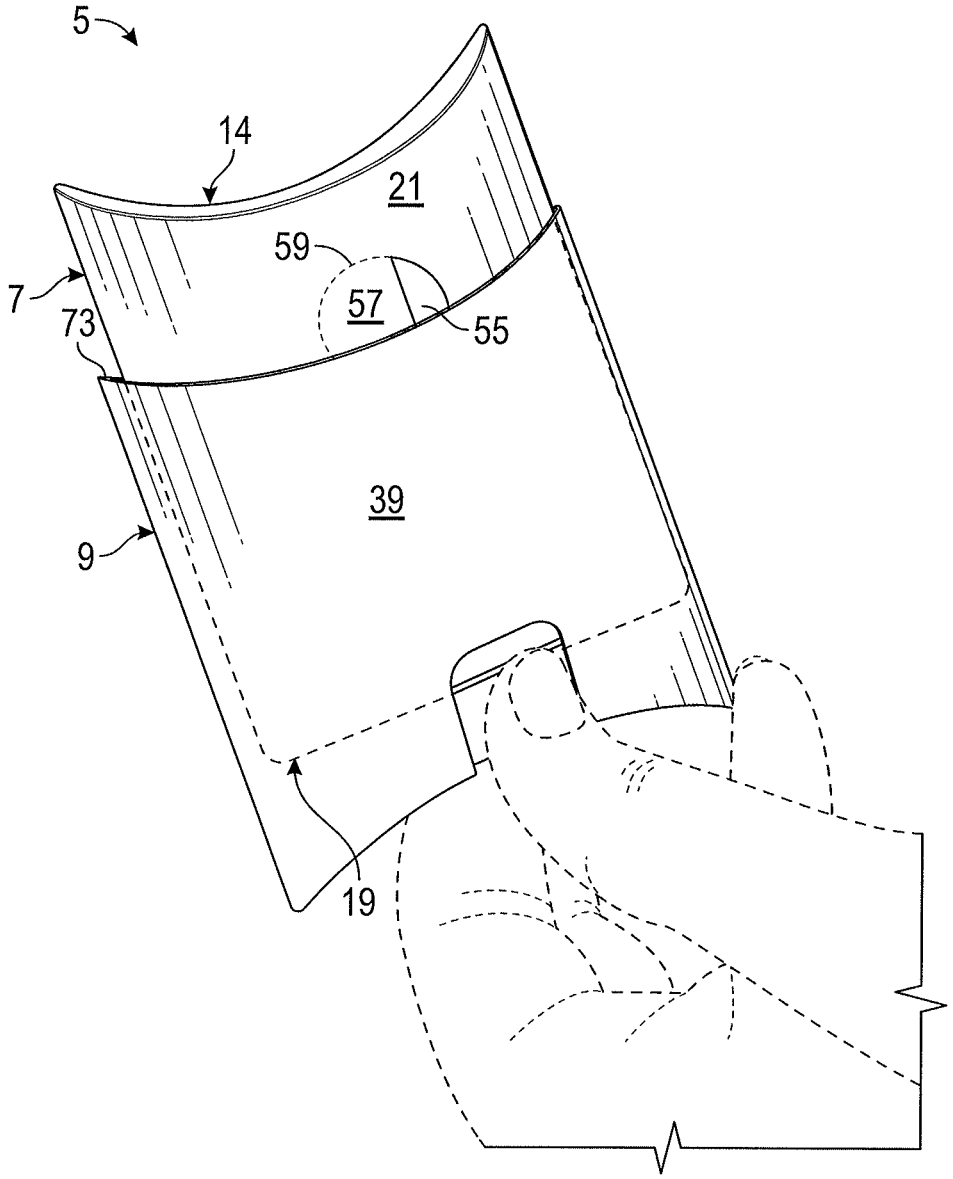
FIG. 9 is a third sequential perspective view of the carton of FIG. 6 in use according to the first exemplary embodiment of the disclosure.

Turning now to FIGS. 7-9, in use, a user can engage the tab 35, for example, by inserting his or her finger into the opening 65 on the first sleeve panel 37, and tear the tab 35 away from the first sleeve panel 37 along tear lines 61, 63 such that the dispenser 7 and the sleeve 9 are devoid of foldable or tearable connection with one another. Separation of the tab 35 from the dispenser 7 also provides visual evidence of use of the carton 5, for example, so that separation of the tab 35 from the sleeve 9 can provide a tamper-evidencing feature for later users of the carton 5. Referring additionally to FIG. 9, a user can then push upwardly on the dispenser 7, for example, on the flap 31 or elsewhere on the closed bottom 19 of the dispenser 7, such that the dispenser 7 slidably moves upwardly through the interior 73 of the sleeve 9 and the dispenser opening 55 is at least partially exposed above the top portion 17 of the sleeve 9. Such upward forcing of the dispenser 7 relative to the sleeve 9 may overcome one or more adhesive connections between the dispenser 7 and the sleeve 9. In this regard, a user can slidably move the dispenser 7 relative to the sleeve 9 between a first position of the dispenser 7 (shown best in FIG. 6), in which the dispenser opening 55 is recessed within the interior 73 of the sleeve 9 such that the sleeve 9 overlaps the dispenser opening 55 so that the dispenser opening 55 is inaccessible, and a second position of the dispenser 7 in which the dispenser opening 55 has a desired exposure above the top portion 17 of the sleeve 9.

Referring additionally to FIG. 10, when the dispenser 7 is in the second position, a user can at least partially remove the dispenser tab 57 from the dispenser opening 55, for example, by inserting one or more of his or her fingers into the dispenser opening 55 and tearing the dispenser tab 57 from the second dispenser panel 23 at least partially along the tear line 59, to expand and provide increased access to the dispenser opening 55. An interior 71 of the dispenser 7 is then accessible through which one or more articles P can be removed and/or inserted into the interior 71 of the dispenser 7.

Figure 11:
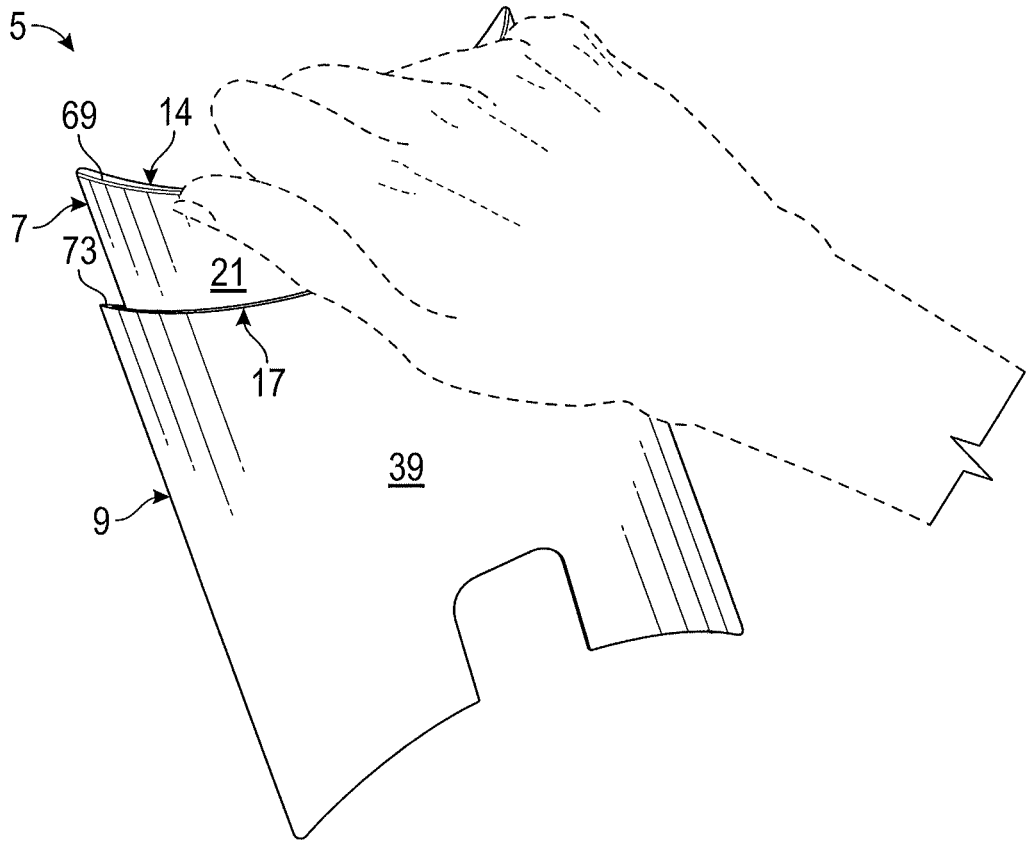
FIG. 11 is a fifth sequential perspective view of the carton of FIG. 6 in use according to the first exemplary embodiment of the disclosure.

Turning to FIG. 11, when access to the interior 71 of the dispenser 7 is no longer required or desired, the dispenser 7 can be moved slidably downward from the second position shown and into the interior 73 of the sleeve 9, for example, by pressing downwardly on the top 14 of the dispenser 7 such that the dispenser 7 is in the first position with the dispenser opening 55 is at least partially covered by the sleeve 9. The lip 69 of the dispenser 7 can engage the top portion 17 of the sleeve 9 to inhibit or prevent further slidable movement of the dispenser 7 downwardly into the interior 73 of the sleeve 9. Such coverage of the dispenser opening 55 by the sleeve 9 can maintain a barrier to the interior 71 of the dispenser 7 to maintain a desired state of articles P stored in the interior 71 of the dispenser 7, for example, for organization, freshness and/or to retain the presence of aromas, flavors, or other properties.

Figure 12:
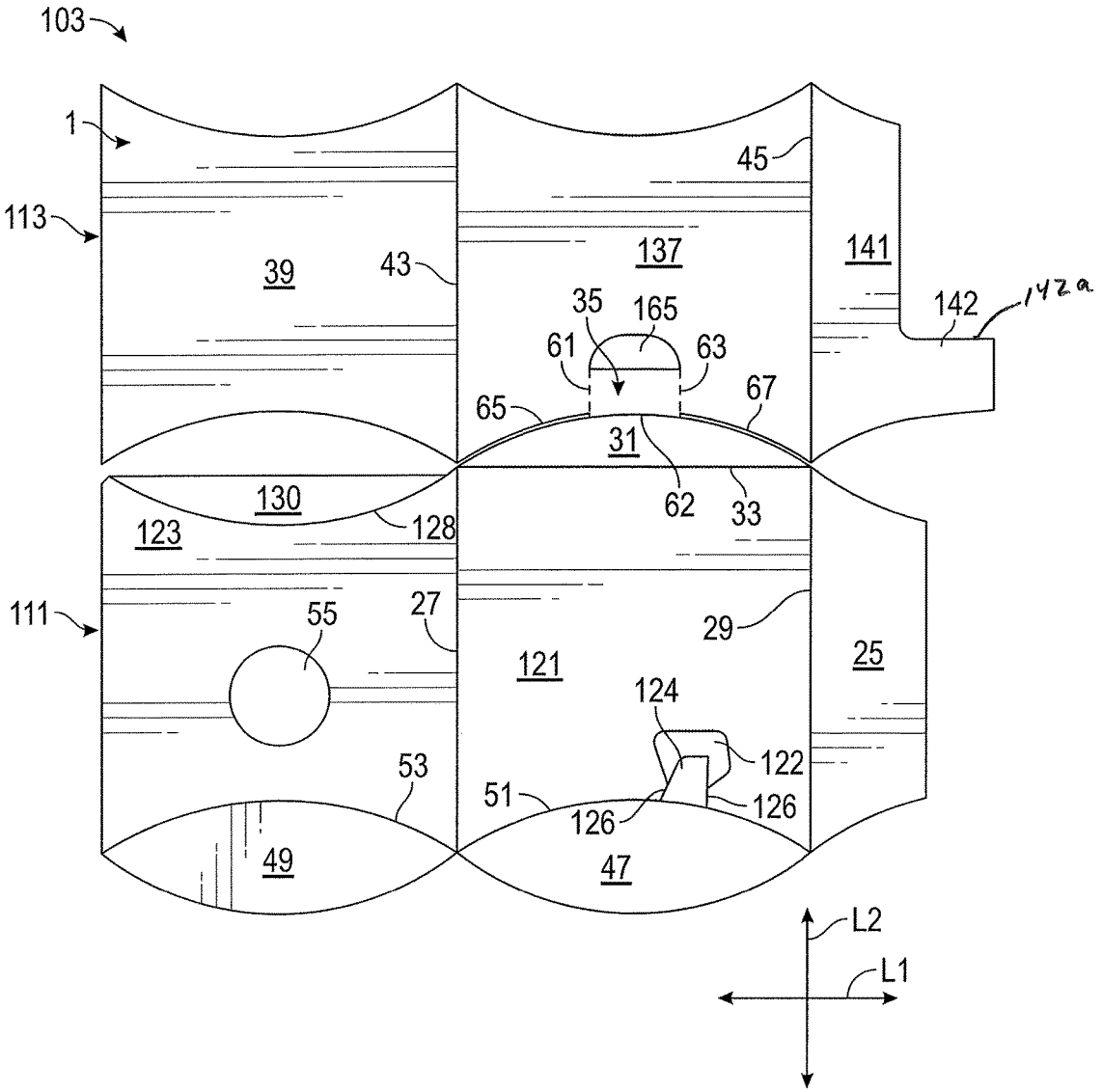
FIG. 12 is a plan view of a blank for forming a carton according to a second exemplary embodiment of the disclosure.

Referring to FIG. 12, a blank 103 for forming a carton 105 with a dispenser 107 and a sleeve 109 (FIG. 16) according to a second exemplary embodiment of the disclosure is illustrated. Portions of the blank 103 and the carton 105 may be substantially similar to the respective blank 3 (FIG. 1) and carton 5 (FIG. 6) of the first exemplary embodiment of the disclosure, and like and similar components are referred to with like or similar reference numbers herein.

The blank 103, as shown, is oriented along the longitudinal axis L1 and the lateral axis L2. The illustrated blank 103 includes a first dispenser panel 121 foldably connected to a second dispenser panel 123 and the attachment flap 25. As also shown, the bottom flap 31 is foldably connected to the first dispenser panel 123 and defines the tab 35, and the top flaps 47, 49 are foldably connected to the respective first and second dispenser panels 121, 123. The first dispenser panel 121 is substantially similar to the first dispenser panel 21 (FIG. 1) of the first embodiment, but includes stopping features (e.g., features that at least partially restrict a range of relative movement of the dispenser 107 and sleeve 109 (FIG. 16)) that include an opening or stopper opening 122 and a stopper tab 124 at least partially defined by a pair of cuts 126, with the stopper tab 124 extending into the opening 122. The second dispenser panel 123 is substantially similar to the first dispenser panel 23 (FIG. 1) of the first embodiment, but the dispenser opening 55 is devoid of a dispenser tab, and the first dispenser panel 123 includes a fold line 128 that forms a bottom flap 130, as shown. In this regard, the first dispenser panel 121, the second dispenser panel 123, the attachment flap 25, and the flaps 31, 47, 49, 130 may form a dispenser portion 111 of the blank 103.

Figure 16:
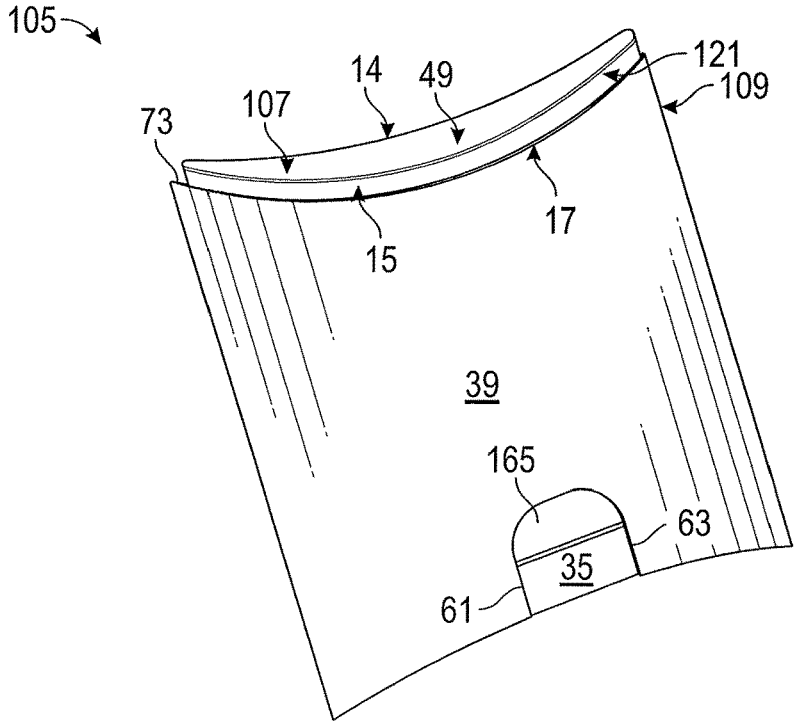
FIG. 16 is a perspective view of a carton formed from the blank of FIG. 12 according to the second exemplary embodiment of the disclosure.

As shown, the blank 103 also includes the first sleeve panel 137, the second sleeve panel 39, and an attachment flap 141 that includes a stopper arm 142 extending outwardly therefrom and forming a portion of the stopping features of the carton 105 (FIG. 16). The stopper arm has a stop edge 142*a* for engaging the stopper tab 124. The first sleeve panel 137 is substantially similar to the first sleeve panel 37 (FIG. 1) of the first embodiment, but defines an opening 165 that has an at least partially complementary configuration to the dispenser opening 55, as described herein. In this regard, the first sleeve panel 137, the second sleeve panel 39, and the attachment flap 141 may form a sleeve portion 113 of the blank 103.

It will be understood that the panels 121, 123, 137, 39, the flaps 25, 31, 130, 141, 47, 49, and/or other portions of the blank 103 may be otherwise shaped or configured without departing from the disclosure.

Figure 13:
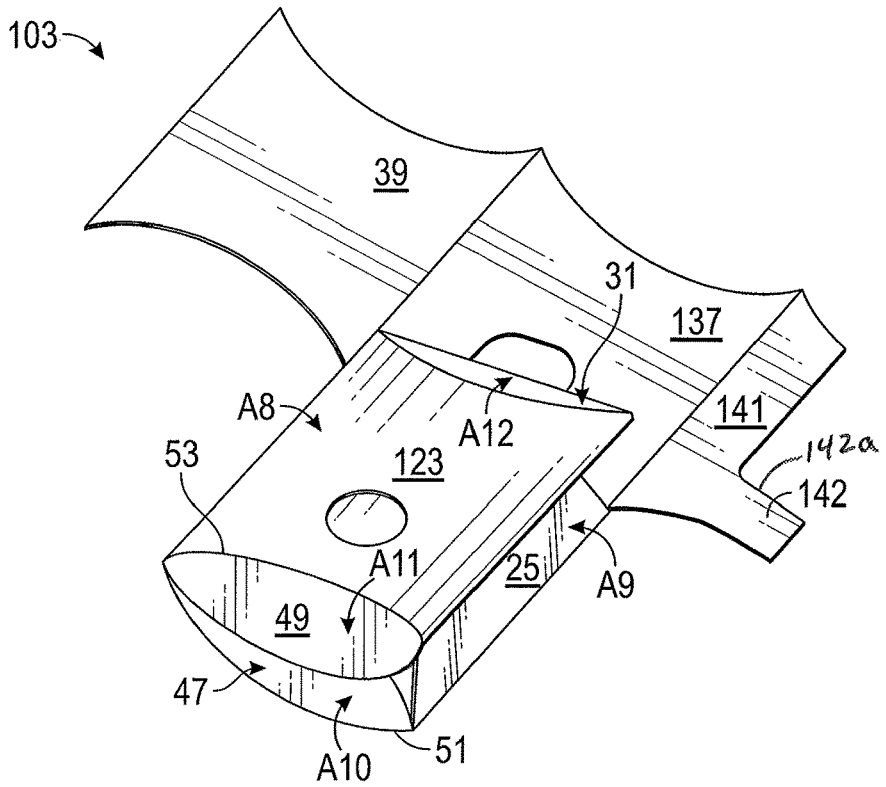
FIG. 13 is a first sequential perspective view of an assembly of the blank of FIG. 12 according to the second exemplary embodiment of the disclosure.
Figure 14:
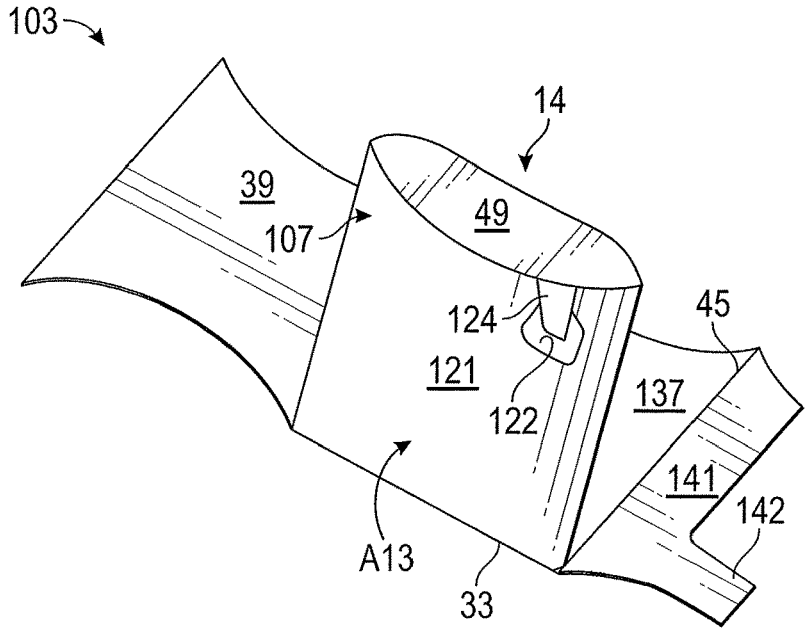
FIG. 14 is a second sequential perspective view of an assembly of the blank of FIG. 12 according to the second exemplary embodiment of the disclosure.
Figure 15:
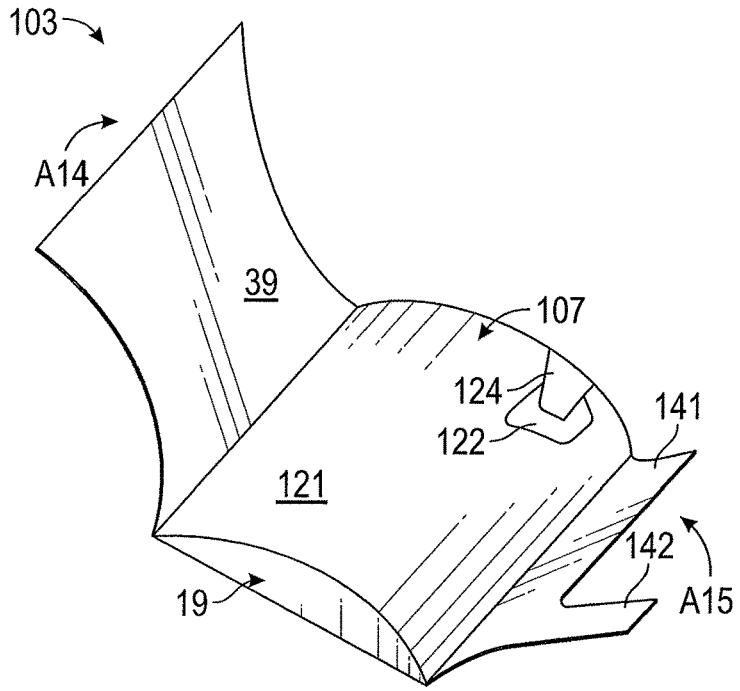
FIG. 15 is a third sequential perspective view of an assembly of the blank of FIG. 12 according to the second exemplary embodiment of the disclosure.

Referring to FIGS. 13-15, the blank 103 can be folded into a carton 105 (FIG. 16) in a similar manner as described above with respect to the blank 3 (FIG. 1) and the carton 5 (FIG. 6) of the first embodiment, and with reference to arrows A8, A9, A10, A11, A12, A13, A14, and A15. As illustrated, the flap 130 can be folded at the fold line 128 in the direction of the arrow A12 to form the closed bottom 19 (FIG. 16) of the carton 105. In addition, the top flaps 47, 49 of the blank 103 may be overlapped in a substantially flush and/or aligned manner such that no protruding lip is present on the carton 105, as compared to the lip 69 (FIG. 6) of the carton 5 (FIG. 6) of the first embodiment. It will be understood that an adhesive such as glue may be applied to portions of the blank 103 to maintain the folded arrangement of the panels 121, 123, 137, 39 and the flaps 25, 31, 130, 141, 47, 49. It will also be understood that one or more articles P (FIG. 18) can be placed in the interior 71 (FIG. 18) of the dispenser 107 (FIG. 16) at any desired point in the assembly of the carton 105 (FIG. 16), which may be loaded manually or with a loading apparatus, and which may be held in the carton 105 (FIG. 16) in a separate (e.g., loose) arrangement or can be provided, for example, with a liner, bag, or other packaging.

Figure 17:
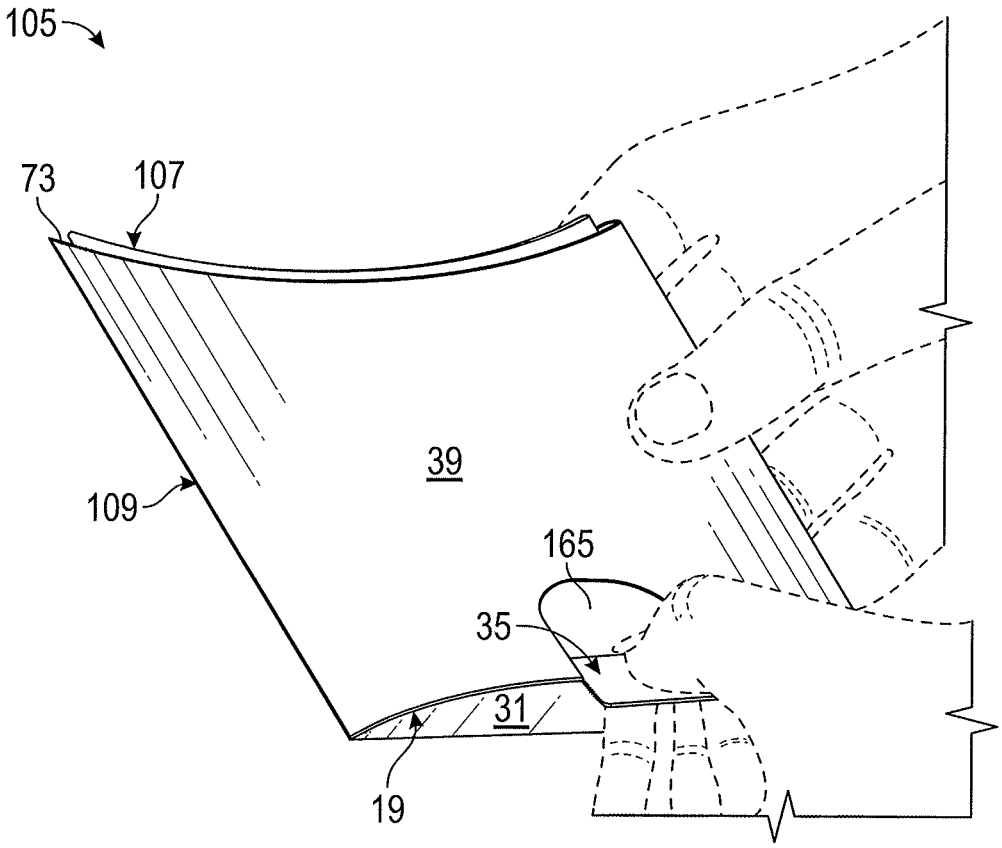
FIG. 17 is a first sequential perspective view of the carton of FIG. 16 in use according to the second exemplary embodiment of the disclosure.

Referring to FIG. 16, the carton 105 is illustrated in a fully-assembled configuration including the dispenser 107 formed from the dispenser portion 111 of the blank 103 (FIG. 12) slidably disposed within a portion of the sleeve 109 formed from the sleeve portion 113 of the blank 103 (FIG. 12). Referring additionally to FIG. 17, in use, a user can engage the tab 35, for example, by inserting his or her finger into the opening 165 on the first sleeve panel 137, and tear the tab 35 away from the first sleeve panel 137 along tear lines 61, 63 such that the dispenser 107 and the sleeve 109 are devoid of foldable or tearable connection with one another. Separation of the tab 35 from the dispenser 107 also provides visual evidence of use of the carton 105, for example, so that separation of the tab 35 from the sleeve 109 can provide a tamper-evidencing feature for later users of the carton 105.

Figure 18:
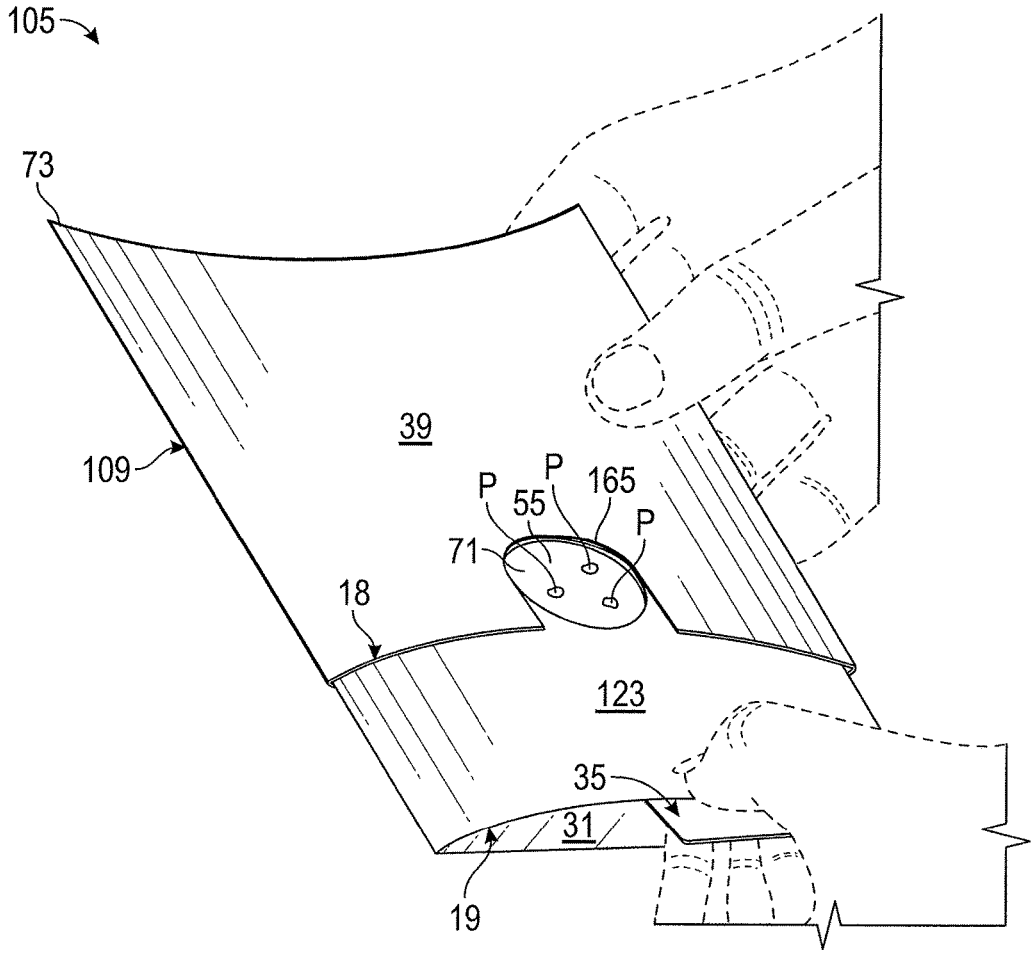
FIG. 18 is a second sequential perspective view of the carton of FIG. 16 in use according to the first exemplary embodiment of the disclosure.

Turning to FIG. 18, a user can push or pull downwardly on the dispenser 107, for example, by pushing downwardly on the top portion 15 (FIG. 16) of the dispenser 107, by pulling downwardly on the closed bottom 19 of the dispenser 107, and/or by pulling downwardly on the tab 35, to cause the dispenser 107 to move downwardly relative to the sleeve 109. Such downward movement of the dispenser 107 moves the dispenser from a first position in which the dispenser opening 55 is recessed within the interior 73 of the sleeve 109 such that the sleeve 109 overlaps the dispenser opening 55 such that the dispenser opening 55 is inaccessible, and a second position of the dispenser 107 in which the dispenser 107 has a desired exposure below a bottom portion 18 of the sleeve 109. As shown, in the second position of the dispenser 107, the opening 165 in the first sleeve panel 137 may complement the configuration of the opening dispenser opening 55 so that the interior 71 of the dispenser 107 can be accessed, for example, to retrieve or replace articles P, as shown.

Figure 19:
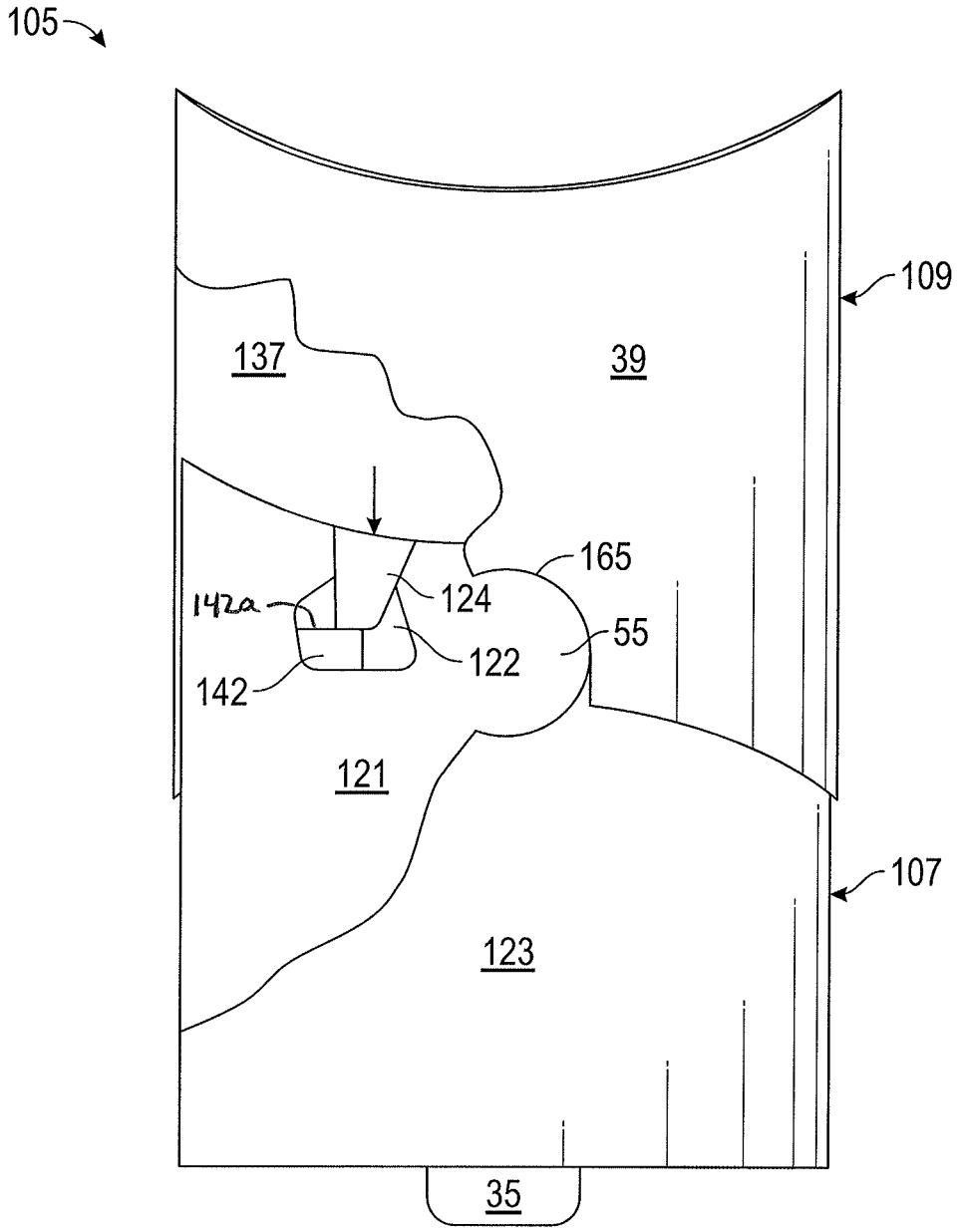
FIG. 19 is a front view, with a portion shown broken away, of the carton of FIG. 16 in an open configuration according to the second exemplary embodiment of the disclosure.

Referring additionally to FIG. 19, when the dispenser 107 is in the second position, the stopper tab 124 of the first dispenser panel 121 is positioned to engage the stop edge 142*a* of the stopper arm 142 of the attachment flap 141 of the sleeve 109 in edge-to-edge contact such that further downward movement of the dispenser 107 relative to the sleeve 109 is inhibited. In this regard, the carton 105 is configured such that the dispenser 107 is at least partially restricted from moving below a desired second position to inhibit or prevent, for example, complete separation of the dispenser 107 and the sleeve 109.

Figure 20:
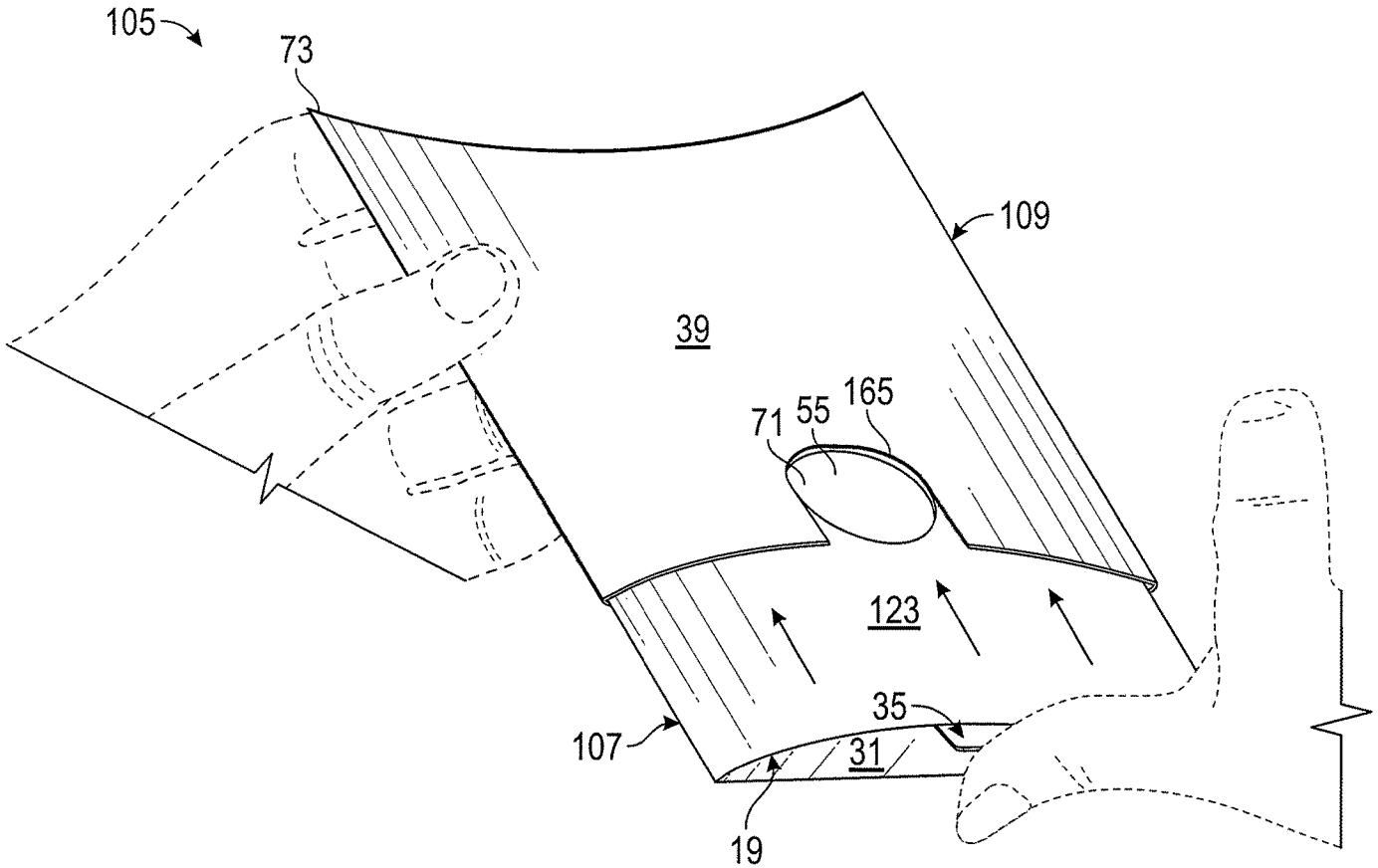
FIG. 20 is a perspective view of the carton of FIG. 16 being moved from an open configuration to a closed configuration according to the second exemplary embodiment of the disclosure.

Turning to FIG. 20, when access to the interior 71 of the dispenser 107 is no longer required or desired, the dispenser 107 can be moved slidably upward from the second position shown and into the interior 73 of the sleeve 109, for example, by pressing upwardly on the closed bottom 19 of the dispenser 107 such that the dispenser 107 is in the first position with the dispenser opening 55 is at least partially covered by the sleeve 109. Such coverage of the dispenser opening 55 by the sleeve 109 can maintain a barrier to the interior 71 of the dispenser 107 to maintain a desired state of articles P stored in the interior 71 of the dispenser 107, for example, for organization, freshness and/or to retain the presence of aromas, flavors, or other properties.

Any of the features of the various embodiments of the disclosure can be combined with, replaced by, or otherwise configured with other features of other embodiments of the disclosure without departing from the scope of this disclosure. Further, the panels, flaps, and/or other features shown and described in conjunction with the blanks, the cartons, and/or the packages of the above embodiments are included by way of example. The inserts and/or other features of the disclosure can alternatively be associated with any suitable carton or blank having any panel and flap configuration.

The cartons according to the present disclosure can be, for example, formed from blanks of coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels, flaps, or features, adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding at least one article, comprising:

a dispenser comprising at least two first panels extending at least partially around an interior of the dispenser, the dispenser comprising a closed first end, a closed second end, and a dispenser feature; and a sleeve comprising at least two second panels extending at least partially around an interior of the sleeve, the sleeve comprising an open first end, an open second end, and the interior of the sleeve at least partially receives the dispenser, the dispenser is in slidable engagement with the sleeve and is moveable between a first position in which the dispenser feature is inaccessible and a second position in which the dispenser feature is accessible.

2. The carton of claim 1, wherein, in the first position of the dispenser, the dispenser feature is covered by the sleeve.

3. The carton of claim 2, wherein, in the second position of the dispenser, the dispenser feature is positioned outside of the sleeve.

4. The carton of claim 1, wherein the dispenser feature comprises a dispenser opening.

5. The carton of claim 4, wherein the dispenser feature comprises a dispenser tab adjacent the dispenser opening and removably connected to a respective panel of the at least two first panels.

6. The carton of claim 5, wherein the dispenser opening is expandable upon removal of the dispenser tab.

7. The carton of claim 4, wherein at least one panel of the at least two second panels comprises a portion having a complementary configuration to the dispenser opening.

8. The carton of claim 1, wherein the dispenser comprises at least one stopping feature.

9. The carton of claim 8, wherein the dispenser comprises at least two end flaps foldably connected to respective panels of the at least two first panels and forming one of the closed first end and the closed second end of the dispenser.

10. The carton of claim 9, wherein the one of the closed first end and the closed second end comprises a closed top comprising a lip extending beyond an edge of the sleeve, the at least one stopping feature comprising the lip.

11. The carton of claim 10, wherein the lip is engageable with the edge of the sleeve to inhibit movement of the dispenser into the interior of the sleeve.

12. The carton of claim 8, wherein the at least one stopping feature comprises a stopper tab in at least one panel of the at least two first panels of the dispenser.

13. The carton of claim 12, wherein the at least one panel of the at least two first panels comprises a stopper opening, the stopper tab extends into the stopper opening, the stopper tab is engageable with a portion of the sleeve to inhibit movement of the dispenser away from the sleeve.

14. The carton of claim 13, further comprising at least one end flap foldably connected to a respective panel of the at least two second panels of the sleeve, the portion of the sleeve is an arm extending from the at least one end flap, the arm comprising a stop edge for engaging the stopper tab.

15. The carton of claim 1, wherein the dispenser comprises at least one bottom flap foldably connected to a respective panel of the at least two first panels and forming one of the closed first end and the closed second end of the dispenser.

16. The carton of claim 15, wherein the carton comprises a tab that is foldably connected to the at least one bottom flap and is removably connected to a respective panel of the at least two second panels.

17. The carton of claim 16, wherein the tab is removably connected to the respective panel of the at least two second panels at at least one tear line.

18. The carton of claim 17, wherein the respective panel of the at least two second panels comprises an opening adjacent the tab.

19. The carton of claim 1, wherein, in the first position, a top portion of the dispenser protrudes above a top portion of the sleeve.

20. The carton of claim 1, wherein, in the first position, the sleeve maintains a barrier to the dispenser feature.

21. A blank for forming a carton for holding at least one article, comprising:

at least two first panels for extending at least partially around an interior of the dispenser, the dispenser comprising a closed first end for forming a dispenser in the carton formed from the blank and a closed second end, at least one panel of at least two first panels comprising a dispenser feature; and at least two second panels for forming a sleeve in the carton formed from the blank and for extending at least partially around an interior of the sleeve, the sleeve comprising an open first end and an open second end, the interior of the sleeve is for at least partially receiving the dispenser when the carton is formed from the blank, the dispenser is in slidable engagement with the sleeve and is moveable between a first position in which the dispenser feature is inaccessible and a second position in which the dispenser feature is accessible when the carton is formed from the blank.

22. The blank of claim 21, wherein, in the first position of the dispenser when the carton is formed from the blank, the dispenser feature is covered by the sleeve.

23. The blank of claim 22, wherein, in the second position of the dispenser when the carton is formed from the blank, the dispenser feature is positioned outside of the sleeve.

24. The blank of claim 21, wherein the dispenser feature comprises a dispenser opening.

25. The blank of claim 24, wherein the dispenser feature comprises a dispenser tab adjacent the dispenser opening and removably connected to a respective panel of the at least two first panels.

26. The blank of claim 25, wherein the dispenser opening is expandable upon removal of the dispenser tab.

27. The blank of claim 24, wherein at least one panel of the at least two second panels comprises a portion having a complementary configuration to the dispenser opening.

28. The blank of claim 21, wherein the dispenser comprises at least one stopping feature when the carton is formed from the blank.

29. The blank of claim 28, wherein the dispenser comprises at least two end flaps foldably connected to respective panels of the at least two first panels for forming one of the first closed end and the second closed end of the dispenser when the carton is formed from the blank.

30. The blank of claim 29, wherein the one of the first closed end and the second closed end comprises a closed top comprising a lip extending beyond an edge of the sleeve when the carton is formed from the blank, the at least one stopping feature comprising the lip.

31. The blank of claim 30, wherein the lip is engageable with the edge of the sleeve to inhibit movement of the dispenser into the interior of the sleeve when the carton is formed from the blank.

32. The blank of claim 28, wherein the at least one stopping feature comprises a stopper tab in at least one panel of the at least two first panels of the dispenser.

33. The blank of claim 32, wherein the at least one panel of the at least two first panels comprises a stopper opening, the stopper tab extends into the stopper opening, the stopper tab is engageable with a portion of the sleeve to inhibit movement of the dispenser away from the sleeve.

34. The blank of claim 33, further comprising at least one end flap foldably connected to a respective panel of the at least two second panels of the sleeve, the portion of the sleeve is an arm extending from the at least one end flap, the arm comprising a stop edge for engaging the stopper tab.

35. The blank of claim 21, wherein the dispenser comprises at least one bottom flap foldably connected to a respective panel of the at least two first panels and forming one of the first closed end and the second closed end of the dispenser when the carton is formed from the blank.

36. The blank of claim 35, wherein the blank comprises a tab that is foldably connected to the at least one bottom flap and is removably connected to a respective panel of the at least two second panels.

37. The blank of claim 36, wherein the tab is removably connected to the respective panel of the at least two second panels at at least one tear line.

38. The blank of claim 37, wherein the respective panel of the at least two second panels comprises an opening adjacent the tab.

39. The blank of claim 21, wherein, in the first position of the dispenser when the carton is formed from the blank, a top portion of the dispenser protrudes above a top portion of the sleeve.

40. The blank of claim 21, wherein, in the first position of the dispenser when the carton is formed from the blank, the sleeve maintains a barrier to the dispenser feature.

41. A method of forming a carton for holding at least one article, comprising:

obtaining a blank comprising at least two first panels and at least two second panels, at least one panel of the at least two first panels comprising a dispenser feature; and folding the at least two first panels to form a dispenser having an interior, a closed first end, and a closed second end, and folding the at least two second panels to form a sleeve having an interior, an open first end, and an open second end, the interior of the sleeve at least partially receives the dispenser and the dispenser is in slidable engagement with the sleeve such that the dispenser is movable between a first position in which the dispenser feature is inaccessible and a second position in which the dispenser feature is accessible.

42. The method of claim 41, further comprising moving the dispenser between the first position and the second position.

43. The method of claim 41, wherein, in the first position of the dispenser, the dispenser feature is covered by the sleeve.

44. The method of claim 43, wherein, in the second position of the dispenser, the dispenser feature is positioned outside of the sleeve.

45. The method of claim 41, wherein the dispenser feature comprises a dispenser opening.

46. The method of claim 45, wherein the dispenser feature comprises a dispenser tab adjacent the dispenser opening and removably connected to a respective panel of the at least two first panels.

47. The method of claim 46, wherein the dispenser opening is expandable upon removal of the dispenser tab.

48. The method of claim 45, wherein at least one panel of the at least two second panels comprises a portion having a complementary configuration to the dispenser opening.

49. The method of claim 41, wherein the dispenser comprises at least one stopping feature.

50. The method of claim 49, wherein the blank comprises at least two end flaps foldably connected to respective panels of the at least two first panels and the folding the at least two first panels further comprises forming one of the closed first end and the closed second end of the dispenser.

51. The method of claim 50, wherein the one of the closed first end and the closed second end comprises a closed top comprising a lip extending beyond an edge of the sleeve, the at least one stopping feature comprising the lip.

52. The method of claim 51, wherein the lip is engageable with the edge of the sleeve to inhibit movement of the dispenser into the interior of the sleeve.

53. The method of claim 49, wherein the at least one stopping feature comprises a stopper tab in at least one panel of the at least two first panels of the dispenser.

54. The method of claim 53, wherein the at least one panel of the at least two first panels comprises a stopper opening, the stopper tab extends into the stopper opening, the stopper tab is engageable with a portion of the sleeve to inhibit movement of the dispenser away from the sleeve.

55. The method of claim 54, further comprising at least one end flap foldably connected to a respective panel of the at least two second panels of the sleeve, the portion of the sleeve is an arm extending from the at least one end flap, the arm comprising a stop edge for engaging the stopper tab.

56. The method of claim 41, wherein the blank comprises at least one bottom flap foldably connected to a respective panel of the at least two first panels to form one of the first closed end and the second closed end of the dispenser.

57. The method of claim 56, wherein the blank comprises a tab that is foldably connected to the at least one bottom flap and is removably connected to a respective panel of the at least two second panels.

58. The method of claim 57, wherein the tab is removably connected to the respective panel of the at least two second panels at at least one tear line.

59. The method of claim 58, wherein the respective panel of the at least two second panels comprises an opening adjacent the tab.

60. The method of claim 41, wherein, in the first position, a top portion of the dispenser protrudes above a top portion of the sleeve.

61. The method of claim 41, wherein, in the first position, the sleeve maintains a barrier to the dispenser feature.

* * * * *